United States Patent [19]

McRae

[11] 4,229,910

[45] Oct. 28, 1980

[54] KNIFE SHARPENING APPARATUS

[76] Inventor: James A. McRae, P.O. Box 21, Beatty, Oreg. 97621

[21] Appl. No.: 966,883

[22] Filed: Dec. 6, 1978

[51] Int. Cl.[3] ..... B24D 15/08

[52] U.S. Cl. ..... 51/211 H; 51/214; 76/82

[58] Field of Search ..... 51/74 BS, 76 BS, 77 BS, 51/82 BS, 109 BS, 156, 205 R, 205 WG, 208, 210, 211 H, 214, 285; 76/82, 82.2, 84, 88

[56] References Cited

U.S. PATENT DOCUMENTS

| | | | |
|---|---|---|---|
| 743,365 | 11/1903 | Wilkins | 76/82 |
| 1,500,241 | 7/1924 | Gum | 51/211 H |
| 1,909,743 | 5/1933 | Blankner | 51/214 |
| 2,052,543 | 9/1936 | Anderson | 51/205 WG |
| 2,098,530 | 11/1937 | Battocchi | 51/214 |
| 2,284,535 | 5/1942 | Park | 51/205 R |
| 2,373,829 | 4/1945 | Hicks | 51/205 WG X |
| 2,458,856 | 1/1949 | Jacobson | 51/214 |
| 2,459,391 | 1/1949 | Otis | 76/82 |
| 3,882,642 | 5/1975 | Sykes | 51/214 X |

*Primary Examiner*—Gary L. Smith
*Assistant Examiner*—Robert P. Olszewski
*Attorney, Agent, or Firm*—Kolisch, Hartwell & Dickinson

[57] ABSTRACT

A knife sharpening apparatus adjustable to maintain a knife at a preselected angle during sharpening. The apparatus includes a platform adapted for supporting a sharpening stone thereon, and a support assembly mounted for shifting along a path substantially normal to the plane of the platform. A bar used in guiding the top edge of a knife blade is mounted on the assembly for shifting relative thereto along such path. To adjust the apparatus, the bar is placed at a "zero" position on the support assembly, and the latter is shifted to place the bar against the top of the stone. The bar is then shifted away from its "zero" position a preselected distance to produce a desired spacing between the bar and the stone, wherein, with a knife blade placed with its working edge against the stone, and its opposite edge against the bar, the blade is held at a desired preselected angle.

6 Claims, 3 Drawing Figures

KNIFE SHARPENING APPARATUS

BACKGROUND AND SUMMARY OF THE INVENTION

The present invention relates to knife sharpening apparatus, and more particularly to such apparatus which is selectively adjustable to accommodate knives having various blade widths and thicknesses.

Knife sharpening devices designed to maintain a knife blade at a preselected angle relative to a sharpening stone are known in the prior art. Such devices generally include a platform for supporting the stone and a guide bar selectively shiftable with respect to the stone to produce a preselected spacing therebetween. The knife blade, when inserted between the stone and the bar, is maintained at a fixed angle during sharpening.

In prior art knife-sharpening apparatus of the type just described, the relative spacing between the bar and the stone is calibrated according to the spacing between the bar and the platform supporting the stone. Such calibration assumes that the stone is of a fixed, constant thickness. In the case where a sharpening stone having a different thickness is used, or where the upper surface of the stone has been worn down, there is no way accurately to set the spacing between the bar and the stone, short of physically measuring such spacing and adjusting the bar accordingly.

An important object of the present invention is to provide a knife sharpening device which substantially overcomes the above-described problem in prior art knife-sharpening devices.

More specifically, it is an object of the present invention to provide a knife sharpening device having a platform for supporting a stone thereon, and a guide bar vertically adjustable with respect to the stone, wherein the spacing between the guide bar and the upper face of the stone may be accurately determined and adjusted.

The present invention in knife sharpening apparatus includes a platform on which a sharpening stone is supported, and a support assembly or assemblies mounted for shifting along a path substantially normal to the plane of the platform. A guide bar mounted on the assembly, and extending substantially parallel to the face of the stone, is shiftable, along with the assembly, to produce a preselected spacing between the bar and the stone. Further, it is shiftable independently, relative to the assembly, to produce a desired spacing between the bar and the stone—such being measured relative to the "preselected spacing". The latter spacing is determined by a scale of markings carried on the assembly. With the knife sharpening apparatus so set, a knife blade placed with its working edge against the face of the stone and its opposite edge against the bar, is held at an accurately determined preselected angle.

These and other objects and advantages of the present invention will become more fully apparent when read in connection with the following detailed description of a preferred embodiment of the invention and the accompanying drawings.

DRAWINGS

DETAILED DESCRIPTION OF A PREFERRED EMBODIMENT OF THE INVENTION

Figure 1:
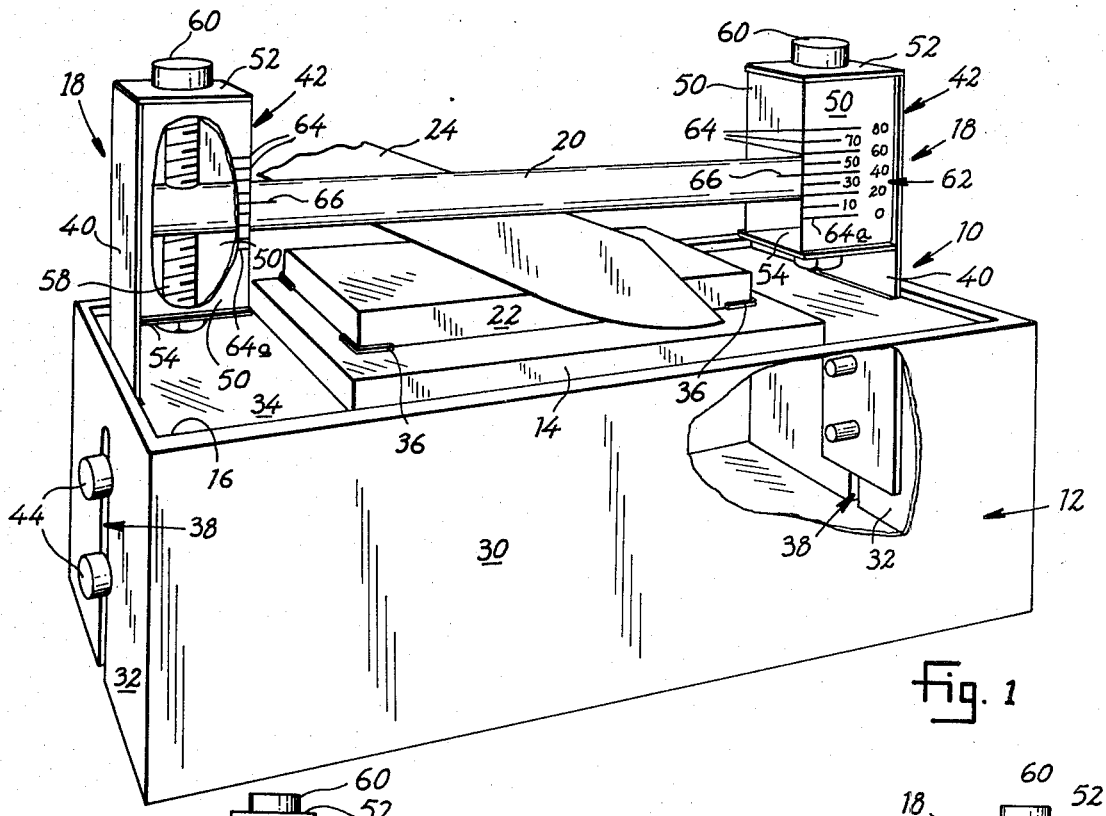
FIG. 1 is a perspective view, with portions cutaway, of a knife sharpening apparatus constructed according to the present invention, shown here in operative condition with a fragmentary portion of a knife blade.
Figure 2:
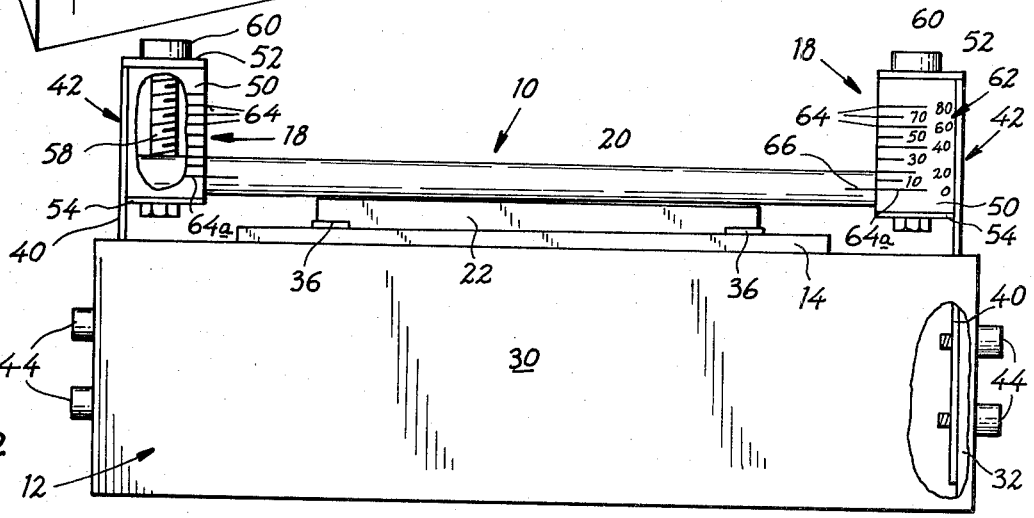
FIG. 2 is a reduced-scale side view of the invention also with portions cutaway.

Referring now to FIGS. 1 and 2, there is shown at 10 a knife sharpening apparatus constructed according to a preferred embodiment of the invention. Apparatus 10 generally includes a frame 12, a stationary platform 14 mounted on the upper surface 16 of the frame, and a pair of opposed support assemblies 18 which are mounted on frame 12 for selected vertical shifting along paths substantially normal to surface 16. A guide bar 20 is mounted at its opposite ends on assemblies 18 for vertical shifting relative thereto, substantially along the path just mentioned. In operative condition, a sharpening stone 22 is supported on platform 14, being held there in a manner to be described. As shown fragmentarily in FIG. 1 a knife blade 24, when inserted between and placed in contact with the sharpening stone and the bar, is held at a substantially fixed angle during a sharpening operation.

Describing the invention in greater detail, frame 10 includes a four-walled structure, as seen in FIG. 1, having pairs of opposed sides 30, 32 and a top 34 secured to the inner portions of walls 30, 32 near the top edge thereof. Platform 14 is a rectangular plate which is securely mounted to upper surface 16 of top 34. The upper surface platform 14 is adapted for releaseably securing stone 22 thereon and, to this end, is provided with four corner guide ridges, such as ridges 36, which serve to immobilize the stone in a horizontal plane. Alternatively, if it is desired to adapt the platform to mount sharpening stones having different rectangular dimensions, the platform may have a series of deepening step-wide ridges (not shown) for receiving the stones of various dimensions therein. Completing the description of the frame, and with continued reference to FIG. 1, opposed side walls 32 are each provided with a central elongate slot 38 extending from the bottom edge of the associated wall vertically upwardly adjacent, but short of, the wall's upper edge. The purpose of slots 38 will be explained shortly.

Each support assembly 18 includes a vertically disposed support bar 40 and a housing 42 secured to, and formed with the upper portion of bar 40. The lower portion of each bar is shiftably mounted on the frame by assembly shifting means which includes a pair of bolts, such as bolts 44, (see the cutaway portions at the right in FIGS. 1 and 2), which bolts extend through associated slots 38 and are threadably engaged with suitable threaded openings in the lower portion of associated bar 40. The heads of bolts 44 are knobs having a base dimension greater than the width of the associated slot. It will be appreciated that tightening of bolts 44 secures the associated bar 40 against the adjacent wall 32.

Each housing 42 includes a pair of opposed side walls 50, attached at their outwardly-facing edges to the upper portion of bar 40, and top and bottom plates 52, 54. Typically, each assembly 18 is constructed from sheet metal, e.g. aluminum bar, with the just-mentioned components of the housing being secured as by welding.

Mounted within each housing 42 is a threaded bolt 58 which is journaled, adjacent its upper and lower ends, within suitable openings in plates 52, 54, respectively, for rotation relative thereto (see the cutaway portions at the left in FIGS. 1 and 2).

Bar 20 includes adjacent each end a suitably threaded opening for threadably receiving therein a bolt 58 as shown. It can be appreciated with reference to FIGS. 1 and 2 that as the two bolts 58 of the two assemblies are simultaneously rotated, in the same direction and by the same amount by manipulation of knobs 60 provided on top of each bolt, bar 20 shifts vertically along a path substantially normal to the base of the platform. Bolts 58, and their operative engagement with the opposite ends of bar 20 are also referred to herebelow as bar shifting means.

Completing the description of the invention, each housing 42 has affixed to one side thereof a scale of markings, indicated at 62. It is noted here that the scale of markings at the left in FIGS. 1 and 2 have been partially obliterated by the cutaways. As shown at the right in FIGS. 1 and 2, scale 62 includes a plurality of markings, such as markings 64, each representing a successive, equally-spaced increment of vertical distance above a zero marking 64*a*. Affixed to the opposite ends of bar 20 along the vertical midline thereof, are a pair of alignment mrkers 66 which are selectively alignable with markings 64, for a purpose to be described. Assemblies 18 provide means for producing a preselected spacing between the associated scales and platform 14.

The use and operation of the instant sharpening device will now be described. Initially, bar 20 is positioned, by rotating bolts 58 as described above, to align markers 66 with zero reference markings, 64*a* on scales 62. Assemblies 18 are then shifted, as described above, to positions in which bar 20 rests on the upper face of stone 22. This operation produces a preselected spacing between the bar and platform 14, which spacing corresponds to the thickness of the stone, wherein what might be thought of as a "zero" position for the bar aligns the bar in a plane defining the upper surface of stone 22.

Figure 3:
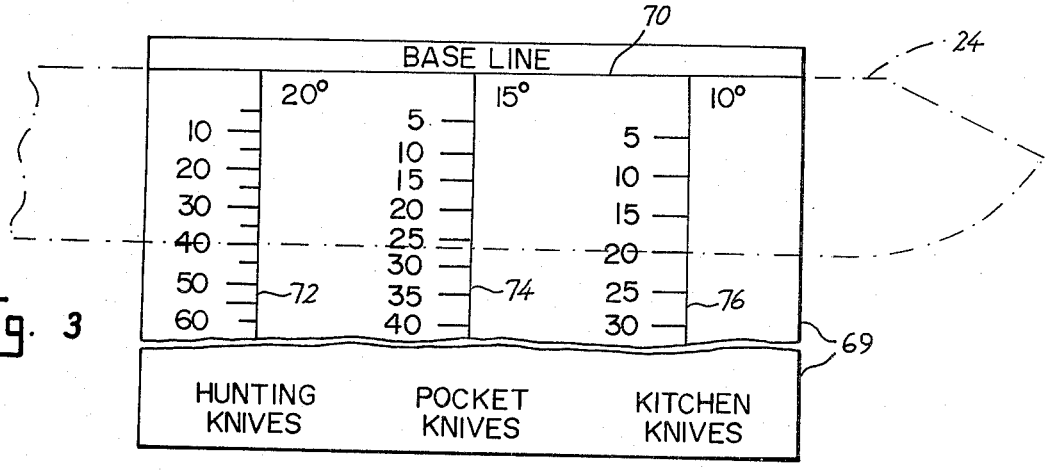
FIG. 3 shows a portion of a chart used in determining the settings for adjusting the apparatus.

To produce a desired preselected spacing between stone 22 and bar 20, the latter is raised, by operating bolts 58, to place markers 66 in alignment with preselected like markings 64 on scales 62. The preselected markings are preferably determined from a chart such as the one illustrated at 69 in FIG. 3. Viewing the chart, there are shown a base line axis 70 and there blade angle axes 72, 74, 76 arranged perpendicular thereto. The markings on the latter axes indicate the markings on scales 62 which will produce the desired blade angle indicated for each such axis. Thus, by way of illustration, assume it is desired to sharpen knife blade 24 at a blade angle of 20°. With one edge of the knife placed along the base line axis in FIG. 3, the other blade edge indicates, on the scale 72, the desired scale marking—in this case, 40—on each scale 62, which, in alignment with bar markers 66, will produce a 20° knife-angle spacing between the stone and the bar. Sharpening is now performable under complete angular blade control by maintaining blade contact both into stone 22 and bar 20 throughout the sharpening operation.

While an embodiment of the invention has been described with a stationary platform, and a rectangular stone, variations are possible to meet various kinds of sharpening needs. For example, a platform may be used which is shiftable to different positions on the frame. Also, different specifically shaped platforms may be used to receive stones having configurations different from the one illustrated.

There has thus been disclosed a knife sharpening device which is adjustable, according to the width of a knife blade, and a desired sharpening angle, to maintain the knife blade at such angle during knife sharpening. It is recognized that various modifications and changes in the invention may be made without departing from the spirit of the invention.

It is claimed and desired to secure by Letters Patent:

1. Knife-sharpening apparatus comprising, in operative condition, a platform supporting a sharpening stone thereon, a bar mounted adjacent said platform, means defining a scale of markings representing spacings between said bar and said platform measured relative to a preselected spacing, shifting means for producing such preselected spacing between said scale-defining means and said platform, and bar shifting means operatively interconnecting said bar and said platform, selectively operable, independent of said shifting means, to produce a desired spacing between said bar and said platform corresponding to a preselected one of said scale markings, wherein a knife blade placed with its working edge against said stone and its opposite edge against said bar is held at a preselected angle relative to said stone.

2. The apparatus of claim 1 wherein said shifting means includes a support assembly mounted for shifting along a path substantially normal to the plane of said platform, with said bar being mounted on said assembly to extend substantially parallel to such plane.

3. The apparatus of claim 2, wherein said bar is mounted on said assembly through said bar shifting means.

4. Knife-sharpening apparatus comprising, in operative condition, a platform supporting a sharpening stone thereon, a bar mounted adjacent said platform, said bar and said platform being relatively shiftable to produce a preselected spacing therebetween, means defining a scale of markings representing spacings between said bar and said platform measured relative to such preselected spacing, bar shifting means operatively interconnecting said bar and said platform, selectively operable to produce a desired spacing therebetween corresponding to a preselected one of said scale markings, wherein a knife blade placed with its working edge against said stone and its opposite edge against said bar is held at a preselected angle relative to said stone, and a support assembly mounted for shifting along a path substantially normal to the plane of said platform, with said bar being mounted on said assembly to extend substantially parallel to such plane.

5. The apparatus of claim 4, wherein said bar is mounted on said assembly through said bar shifting means.

6. The apparatus of claims 4 or 5, wherein said assembly carries said means defining said scale of markings.

* * * * *